US006311509B1

(12) United States Patent
Cartwright et al.

(10) Patent No.: US 6,311,509 B1
(45) Date of Patent: Nov. 6, 2001

(54) CHILLER WITH AUTOMATIC PROBE DETECTION AND FILTERED TEMPERATURE DISPLAY

(75) Inventors: Richard W. Cartwright, Piqua; Al D. Smith, Holt; Walter J. Boryca; David Charles Edelmann, both of Troy, all of OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/748,674

(22) Filed: Dec. 22, 2000

(51) Int. Cl.[7] ..... F25B 49/02
(52) U.S. Cl. ..... 62/213; 62/130; 62/131
(58) Field of Search ..... 62/213, 203, 130, 62/228.1, 208, 129, 131, 125, 126, 127, 229; 236/15 BB, 51, 91 R, 91 A, 91 E

(56) References Cited

U.S. PATENT DOCUMENTS

| | | | | |
|---|---|---|---|---|
| 2,110,192 | | 4/1935 | Bellamy . | |
| 4,003,728 | | 1/1977 | Rath . | |
| 4,021,213 | | 5/1977 | Neidhardt et al. . | |
| 4,298,947 | | 11/1981 | Tamura et al. . | |
| 4,372,099 | | 2/1983 | Linville . | |
| 4,569,204 | | 2/1986 | Ott et al. . | |
| 4,621,502 | | 11/1986 | Ibrahim et al. . | |
| 4,627,742 | | 12/1986 | Sakamoto et al. . | |
| 4,697,429 | * | 10/1987 | Chandler et al. | 62/203 |
| 4,757,691 | | 7/1988 | Compagnon . | |
| 4,788,827 | | 12/1988 | Otani . | |
| 4,882,851 | | 11/1989 | Wennerstrum et al. . | |
| 4,934,151 | * | 6/1990 | Shima | 62/208 X |
| 5,003,785 | * | 4/1991 | Petri et al. | 62/131 |
| 5,249,863 | | 10/1993 | Brown . | |
| 5,262,758 | | 11/1993 | Nam et al. . | |
| 5,263,332 | * | 11/1993 | Park | 62/131 X |
| 5,284,024 | | 2/1994 | Hanson et al. . | |
| 5,311,746 | * | 5/1994 | Dombrowski et al. | 62/131 |
| 5,377,622 | | 1/1995 | Lauttenbach et al. . | |
| 5,404,935 | | 4/1995 | Liebermann . | |
| 5,421,246 | | 6/1995 | Tippmann et al. . | |
| 5,460,006 | | 10/1995 | Torimitsu . | |
| 5,647,220 | * | 7/1997 | Kawaguchi et al. | 62/213 X |
| 5,826,432 | | 10/1998 | Ledbetter . | |
| 5,893,270 | | 4/1999 | Arph . | |
| 5,902,618 | | 5/1999 | Haasis, Jr. . | |
| 6,000,845 | | 12/1999 | Tymkewicz et al. . | |
| 6,056,985 | | 5/2000 | Fluckiger et al. . | |

FOREIGN PATENT DOCUMENTS

| | | |
|---|---|---|
| 1302089 A | 12/1989 | (JP) . |
| 5149670 A | 6/1993 | (JP) . |
| 08113493 | 5/1996 | (JP) . |

OTHER PUBLICATIONS

Hobart Corp. HQC45 Quickchill & HQCF45 Quickchill Freezer Instructions (Form 34374 (9–99)).

* cited by examiner

*Primary Examiner*—Harry B. Tanner
(74) *Attorney, Agent, or Firm*—Thompson Hine LLP

(57) ABSTRACT

In a chiller, an apparatus and method for automatically identifying a temperature probe for use in a chilling operation is provided in order to reduce user error. In the place of manual selection by a user, automatic selection of the appropriate temperature probe is accomplished by comparing the temperature of the given temperature probe to a threshold temperature. An additional apparatus and method for filtering a displayed compartment temperature is provided to reduce user confusion. The responsiveness of the displayed temperature to temperature changes in the compartment is reduced when the compartment door is opened.

42 Claims, 4 Drawing Sheets

CHILLER WITH AUTOMATIC PROBE DETECTION AND FILTERED TEMPERATURE DISPLAY

FIELD OF THE INVENTION

The present invention relates generally to commercial food chilling equipment and, more particularly, to chillers having features for minimizing the potential for user error and confusion during the set-up and monitoring of a chilling operation.

BACKGROUND OF THE INVENTION

Commercial food product chillers, commonly referred to as blast chillers, are typically used to chill hot food products to a safe temperature for storage. For example, a hot food product at 145° F. to 160° F. or more may be taken just out of the oven, placed in the chiller, and rapidly cooled to a low temperature of 40° F. or less. Such rapid chilling of the food product is desirable for a variety of reasons, including food safety.

Known food product chillers generally operate in one of two modes, namely a chill by temperature mode or a chill by time mode. In the chill by temperature mode a temperature probe is placed in the food product and the desired chilled temperature of the food product can be entered into the machine by a user. The chilling operation then runs until the temperature probe indicates that the food product has reached the desired chilled temperature. In the chill by time mode, a user simply enters a time period for chilling the food product and the chilling operation then runs for the entered time period. In either type of chilling operation a user may also set the type of chill (hard or soft), and/or a desired air temperature within the chilling compartment. Some chillers are also configured to operate in a freeze mode for freezing food products. As used herein the term "chiller" broadly encompasses both units which include a freeze mode and units which do not include a freeze mode.

One opportunity for user error with known chillers occurs during the initialization of a chill by temperature operation when the user must select one of several temperature probes to monitor the cooling cycle of a hot food product. When this step is performed properly, the user will insert a given temperature probe into a hot food product and identify the inserted probe for use in the chilling operation through a user input device. For this purpose the probes are typically numbered. The identified temperature probe will then monitor the temperature of the food product as it is cooled. Occasionally, however, the user will accidentally identify a different temperature probe than the one placed into the hot food product causing the cooling cycle of the food product to run improperly. When this error occurs it may also be necessary to discard the food product. Consequently, it would be desirable to provide a method for automatically identifying for use a temperature probe that has been placed into a hot food product, thereby eliminating the potential for user error.

Another opportunity for user confusion occurs during the loading and unloading of food products through a chiller door. Because opening of the chiller door can cause rapid temperature increases in the cooling compartment, users who monitor the cooling compartment temperature through a temperature display may become concerned that the chilling operation has been interrupted. When this confusion occurs users will occasionally discard food products as waste thinking them unsafe. A similar problem can occur in other types of cooling apparatus such as refrigerators having temperature displays. Accordingly, it would be desirable to provide a method for filtering the temperature that is displayed to the user in a manner such that the responsiveness of the display to rapid temperature changes in the cooling compartment is reduced when the door is opened, thereby eliminating the potential for user confusion.

SUMMARY OF THE INVENTION

In a first aspect of the present invention, a chiller apparatus is provided including a chilling compartment, a chilling system for chilling the chilling compartment, and a plurality of temperature probes for monitoring the temperatures of food products during chilling operations. A controller is coupled to the temperature probes for receiving signals therefrom and is capable of determining whether to identify a given temperature probe for use in a chilling operation based, at least in part, on a signal received from the given temperature probe.

In a second aspect of the invention, in a chiller including a chilling compartment having a plurality of temperature probes associated therewith, a method for automatically determining whether a given temperature probe has been selected for use in a chilling operation is provided. The method involves comparing a temperature of the given temperature probe to a threshold temperature; and determining whether the given temperature probe has been selected for use in the chilling operation based at least in part upon the comparison. In one embodiment the determination is made in order to automatically identify the given probe for use in the chilling operation if a user selected the given probe by placing it in a hot food product. In another embodiment, the given probe may be examined based upon user identification of the given probe via a user input device, wherein the determination is made in order to verify that the user identification of the given probe was correct.

In a third aspect of the invention, a method for displaying an air temperature of a cooling compartment involves altering the responsiveness of the temperature that is displayed to temperature changes according to the status of the cooling compartment door as being open or closed. When the door is closed the temperature that is displayed is most responsive to temperature changes in the cooling compartment. When the door is open the responsiveness of the temperature display to temperature changes is decreased in order to reduce the likelihood of user confusion.

In the fourth aspect of the present invention, a cooling apparatus is provided including a cooling compartment, a cooling system for cooling the cooling compartment, and a door which can be opened to load or unload food products from the cooling compartment. An air temperature sensor is used to obtain an air temperature of the cooling compartment and a display device is used to display the air temperature to the user. A controller is coupled to the air temperature sensor and the display device for displaying a temperature based, at least in part, on a signal received from the air temperature sensor. The controller is also coupled to a door state sensor and is operable at least once during an open state of the door to reduce the responsiveness of the display temperature to temperature changes in the cooling compartment.

DETAILED DESCRIPTION OF THE EMBODIMENTS

Figure 1:
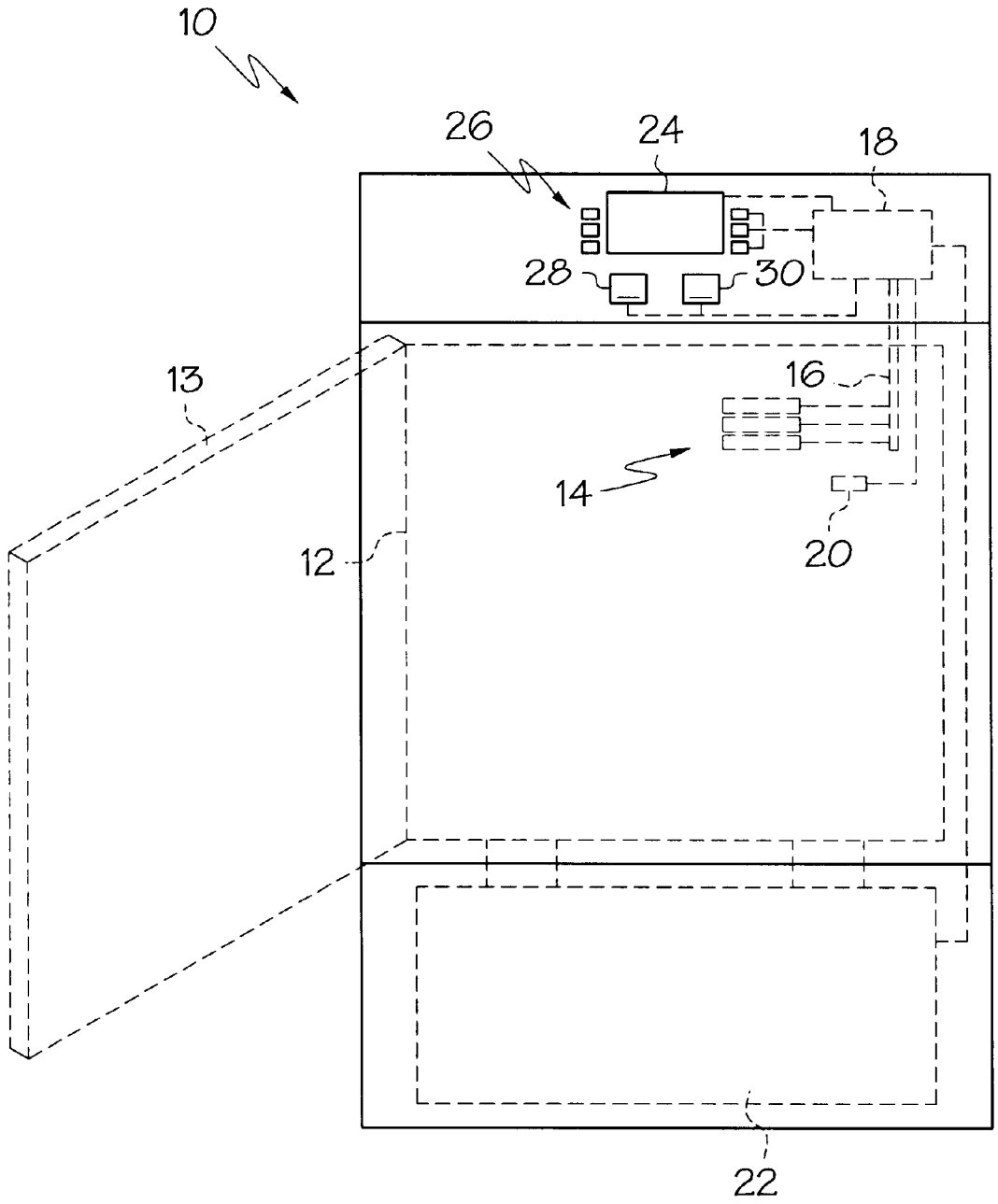
FIG. 1 is a schematic depiction of one embodiment of a chiller.

Referring to drawing FIG. 1, a schematic depiction of a chiller 10 according to one embodiment of the present invention is shown. The chiller 10 includes a chilling compartment 12 which may include multiple racks or shelves (not shown) for receiving food products to be chilled, the compartment typically defined by an insulated housing having an associated door 13 movable between open and closed positions. A plurality of temperature probes 14 are positionable in the chilling compartment 12 for insertion into food products placed in the chilling compartment 12. The probes 14 may be connected to a common wiring harness 16 which extends to a controller 18. The probes 14 output temperature indicative signals to the controller 18. An air temperature sensor 20 is also provided for sensing the temperature of air in the chilling compartment 12 and producing a temperature indicative signal which is delivered to the controller 18. A chilling system 22, operated by the controller 18, generates chilled air which is delivered to the chilling compartment 12 during chilling operations. The chilled air may be circulated through the chilling compartment and back to the chilling system using one or more fans or blowers (see FIG. 2).

The controller 18 is also connected to a display device 24, such as an LCD screen or VF display, for effecting display of information to a user. A user input device 26 is provided for allowing a user to input information to the controller 18. In one embodiment the user input device 26 may be a series of input keys or buttons along the sides of the display device 24 which allow a user to initiate actions or enter information according to information displayed on a portion of the display device 24 alongside the keys. Other user input devices could be used. For example, the user input device could be combined with the display device in the form of a touch screen display, or an alphanumeric data entry key array could be provided.

The chiller includes a label printing mechanism 28 having an associated supply of adhesive label stock. The controller 18 is connected for effecting printing of labels by the printing mechanism 28. A ticket printing mechanism 30 having an associated supply of non-label print stock is also provided, with the controller 18 connected to effect printing of tickets by the printing mechanism 30. In one embodiment, the printing mechanisms may be formed by thermal print heads.

Figure 2:
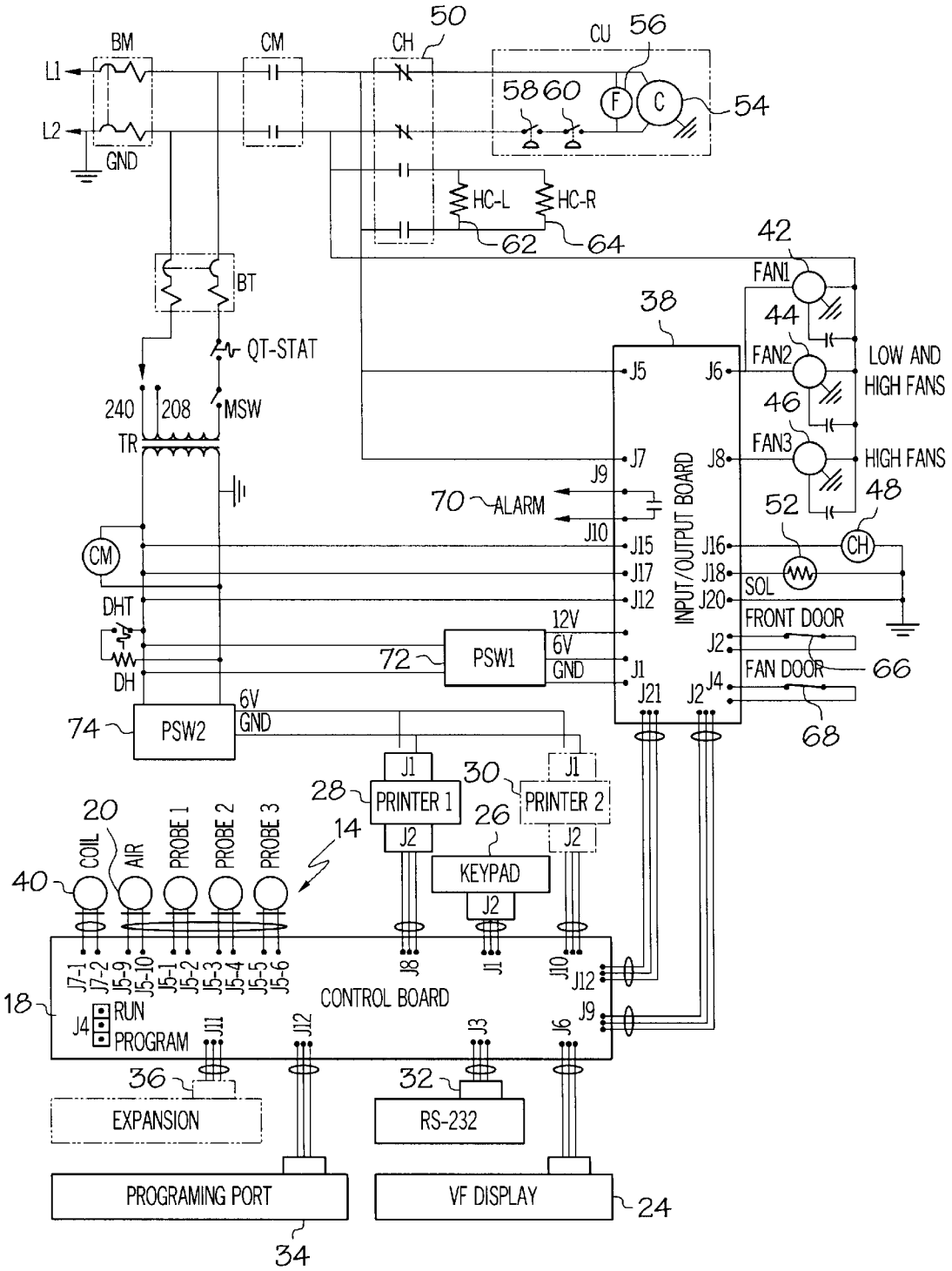
FIG. 2 is a wiring schematic of the chiller of FIG. 1.

Referring now to FIG. 2, a schematic diagram of chiller wiring is shown. The controller 18 may include an RS-232 communications interface 32, a programming interface 34, and an expansion interface 36. The programming interface 34 may be used to reprogram the controller 18. In the illustrated embodiment the controller 18 is connected directly to certain components and indirectly, through input/output board 38, to others. The controller is directly connected to each of the temperature probes 14, the air temperature sensor 20, the user input device 26, the display device 24, and the printing mechanisms 28 and 30. The controller is also directly connected to an evaporator coil temperature sensor 40 which may be used in defrost operations of the coil.

The controller 18 is connected through input/output board 38 to fans 42, 44 and 46 for controlling the flow of chilling air through the chilling compartment. The controller 18 is connected through input/output board 38 to the coil portion 48 of the coil heater relay CH which effects contactor portion 50. The controller 18 is also connected through the input/output board 38 to solenoid 52 which is connected in line with the chilling system 22 to control the flow of the refrigerant fluid. Because operation of the compressor motor 54 and fan 56 of the chilling system 22 is responsive to high and low pressure switches 58 and 60, the chilling system can be controlled via control of the solenoid 52. Left and right heater elements 62 and 64 are provided for defrosting.

A front door switch 66 and fan door switch 68 are also connected through input/output board 38 to controller 18 and properly positioned for providing signals indicative of the open/closed state of each of the chilling compartment door 13 and fan compartment door (not shown). Contact, magnetic, optical or other suitable switches could be used. The controller 18 can also effect operation of an alarm 70, such as a beeper, light or other annunciator, through the input/output board 38. Power supplies 72 and 74 are also shown.

Figure 3:
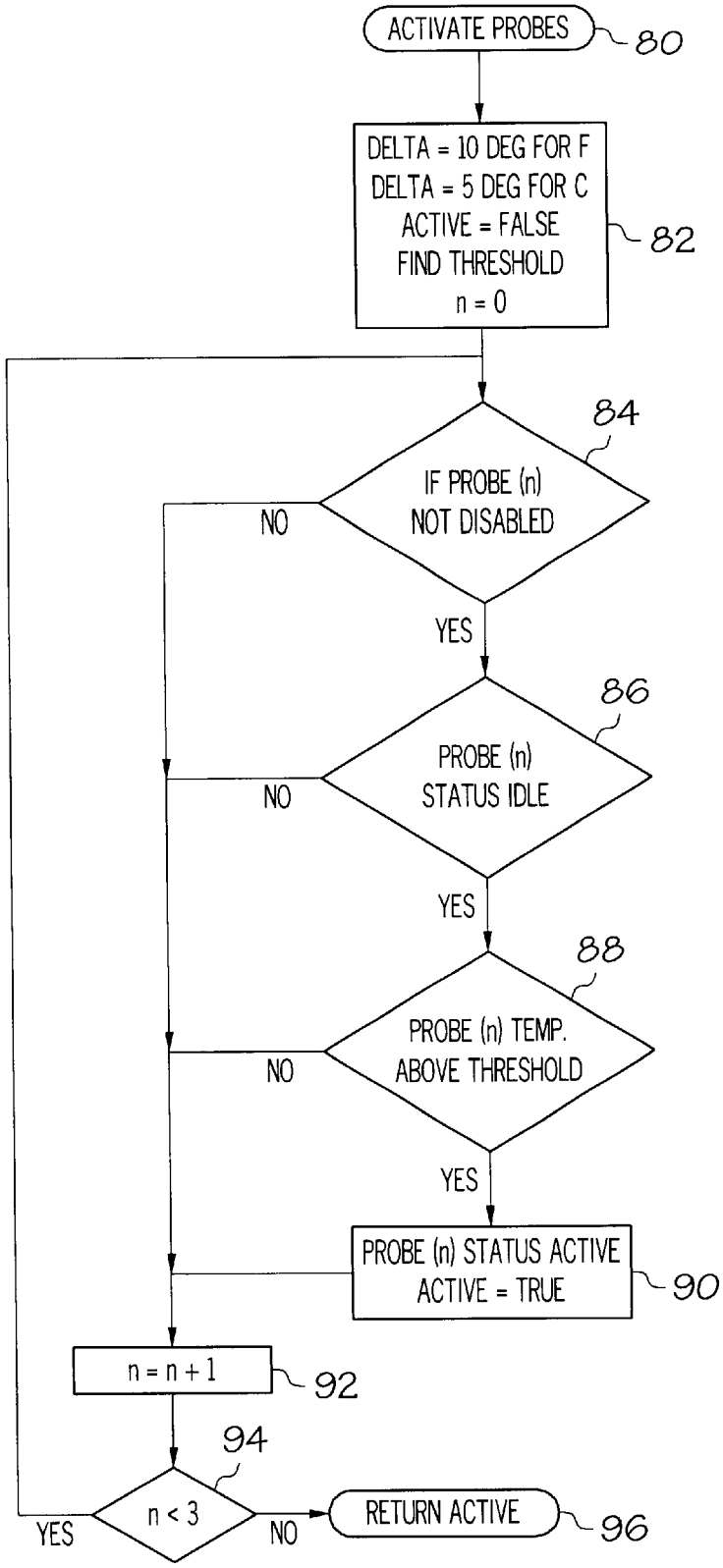
FIG. 3 is a flowchart depicting one embodiment of an automatic probe detection algorithm.

Referring now to FIG. 3, one embodiment of an automatic probe detection method is shown and is identified as an Activate Probes routine. The operations of the method may be performed by the controller 18 which includes associated memory (EEPROM, RAM, ROM and/or other memory) for storing operating code and other information. The data that are used to carry out the operations of the method are supplied to the controller 18 by the plurality of temperature probes 14, the air temperature sensor 20, and the user input device 26. The method may be started when a user, via the user input device 26, requests a chill by temperature operation after at least one of a plurality of temperature probes 14 is inserted into a hot food product. Of course in other embodiments the method could be performed continuously in which case the temperature probe 14 could be inserted into a food product at any time in relation to the start of the method.

The Activate Probes routine is initiated at step 80. A number of variables are then initialized in step 82. The variables include: a count variable (n) that identifies which temperature probe is currently under consideration for use; a status variable (ACTIVE) that indicates whether one or more probes are active—initialized to false; and a temperature variable (delta) is set to a given value. In the embodiment pictured in FIG. 3, the temperature variable (delta) is a stored parameter that cannot be altered by the user. In other embodiments, however, the temperature variable (delta) could be variable by the user by means of the user input device 26 or could be varied automatically.

No matter how delta is set, in the illustrated embodiment it is then added to some measured temperature in step 82 to calculate a threshold temperature. The threshold temperature may be calculated by adding the temperature variable (delta) to a measured air temperature in the chilling compartment as determined by the air temperature sensor 20. In other embodiments however, a unique threshold temperature could be calculated for each temperature probe by adding the temperature variable (delta) to a prior measured temperature of each temperature probe that had been stored in memory by the controller 18. In some applications the threshold temperature may simply be a predetermined constant stored in memory.

Starting with the first temperature probe and proceeding sequentially through each of the temperature probes, a series of operations is used to determine whether to identify each probe for use in a chilling operation. When the operations are completed on any given probe the counter variable (n) is increased and the next probe sequentially is considered. In the embodiment shown in FIG. 3, each temperature probe will be considered in turn only once. Therefore, at least one temperature probe 14 should be inserted into a hot food product before the method is started in step 80 in order for a temperature probe to be identified for use. In other embodiments, however, the steps could repeat for a certain time period to give a user a chance to insert a probe.

In step 84, the disabled status of the temperature probe currently under consideration is tested. A probe may be disabled because it is not functioning properly. If it is determined that the probe currently under consideration is disabled, then the counter variable is increased and the next temperature probe is considered. If it is determined that the probe currently under consideration is not disabled, then the idle status of the probe is tested in step 86.

A temperature probe that is currently in use in a chilling operation is not idle and therefore not available for identification for use in another chilling operation. If the status of the probe is determined not to be idle then the counter variable (n) is increased at step 92 and the next temperature probe is considered. If the status of the probe currently under consideration is determined to be idle, then the temperature of the probe is compared, in step 88, to the threshold temperature.

A primary assumption of the embodiment shown in FIG. 3 is that the temperature of a probe that is not in a food product will be close to the air temperature of the chilling compartment since the probes are stored in the chilling compartment when not in use. Therefore, if the temperature of a probe is greater than the air temperature of the chilling compartment plus the temperature variable (delta), that is greater than some threshold temperature, then a conclusion is made that the probe has been inserted into a hot food product. Consequently, in step 88 the temperature of the probe currently under consideration is compared to the threshold temperature to determine whether to identify the probe for use in a chilling operation. If the temperature of the probe does not exceed the threshold temperature then the counter variable (n) is increased in step 92 and the next temperature probe is considered. If the temperature of the probe currently under consideration does exceed the threshold temperature then the probe under consideration is set to active and the status variable (ACTIVE) is changed from false to true in step 90. A probe status table may be maintained in memory for identifying active probes, and the probe may be set to active by flipping a bit in the table. Once set to active, the probe has been identified for use in a subsequent chilling operation. Even after a probe is identified for use in a chilling operation the counter variable (n) is increased in step 92 and the next temperature probe is considered in case the user has elected to use more than one probe.

In the embodiment shown in FIG. 3 only three temperature probes are envisioned for use although clearly more could be used. In step 94 a determination is made as to whether all of the temperature probes have been considered by comparing the counter variable (n) to the specified number of probes (3 in this case). If the counter variable is less than the specified number of probes then the automatic probe detection algorithm is not completed and step 84 will be repeated. If the counter variable is not less than the specified number of probes then all probes have been checked and the state of the status variable (ACTIVE) is returned. If ACTIVE has been set to true, the controller 18 examines the probe status table to determine which probe or probes to use in the chilling operation, and may also display via the display device 24 which probes will be used. If ACTIVE is still false, then no probe has been identified and the controller 18 may query the user via the display device 24 to manually insert and identify a probe.

Where a user does manually identify which probe to use in a chilling operation, the controller 18 may verify whether the user's identification is correct. For example, if a user manually identifies a given probe for use the controller 18 may monitor that probe for a period of time to determine if that probe has in fact been placed in a hot food product. Such monitoring would similarly be achieved by evaluating whether the temperature of the given probe rises above a threshold temperature. If a determination is made that the manually identified probe was in fact placed in a hot food product the chilling operation may proceed as normal. On the other hand, if temperature of the manually identified probe does not rise above the threshold temperature the controller determines that the user accidentally identified the incorrect probe and may prompt the user via the display device or an alarm to verify and/or correct the probe identification.

Figure 4:
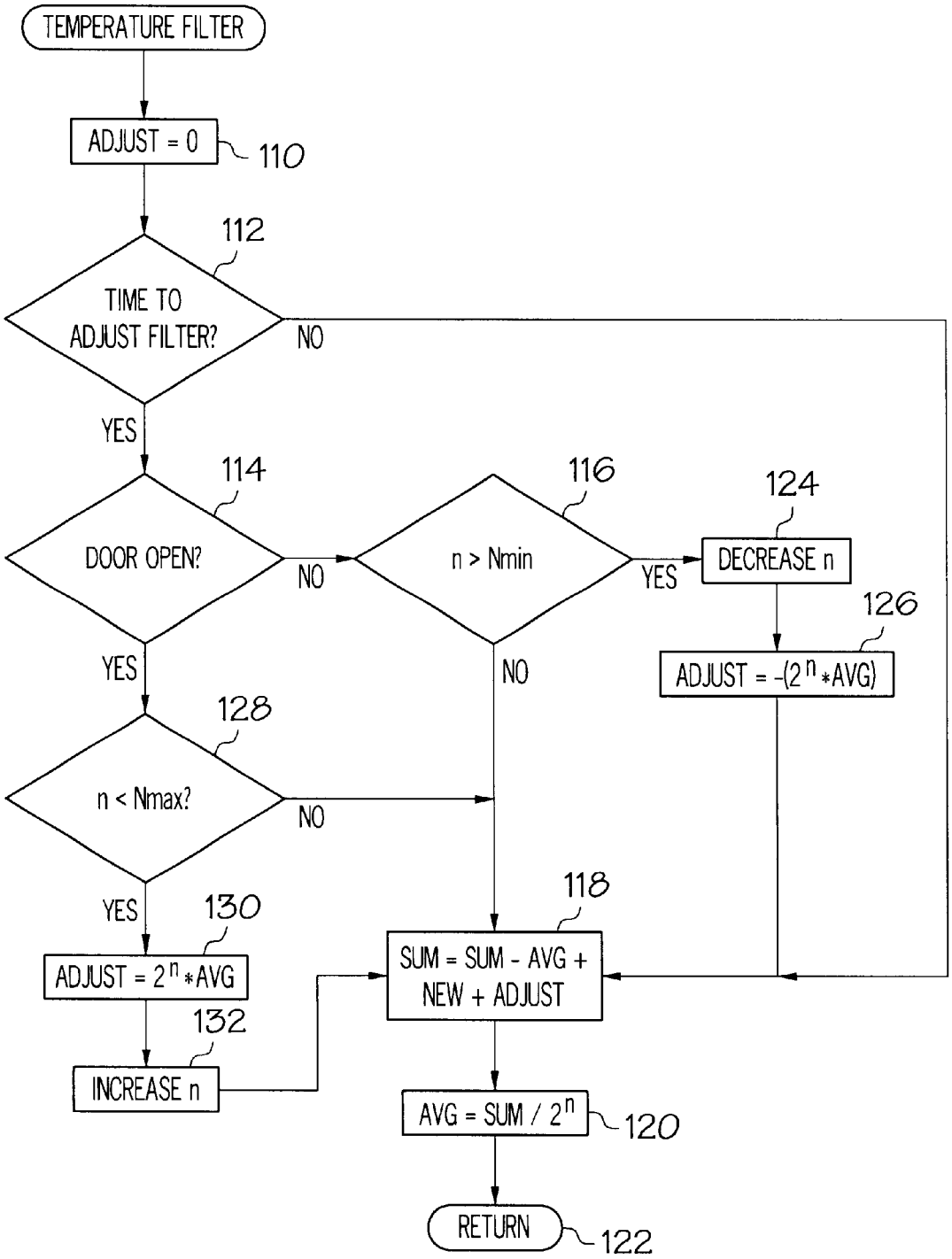
FIG. 4 is a flowchart depicting one embodiment of a temperature filtering algorithm.

Referring now to FIG. 4, one embodiment of a temperature filtering method is shown. The steps of the method may be performed by the controller 18 which includes associated memory (EEPROM, RAM, ROM and/or other memory) for storing operation code and other information. The data that are used to carry out the operations of the algorithm are supplied to the controller 18 by the air temperature sensor 20 and the front door switch 66. Although at least four distinct filtering methods are contemplated, only one such method is shown in FIG. 4. In each method, including the one shown in FIG. 4, adjustments to the filtering operation are initiated when the chilling compartment door 13 is opened as determined by the front door switch 66.

The illustrated embodiment of the present invention that is shown in FIG. 4 utilizes a continuously repeating algorithm that begins in step 110 with the initialization of variables. These variables include an adjustment variable (Adjust) which is set to zero. After initialization of the variables in step 110, in step 112 a determination is made as to whether it is time to consider adjusting the filtering procedure. This determination can be made, for example, by measuring absolute time, i.e., every 5 seconds, or by counting the number of complete passes through the algorithm, i.e., every 10 passes.

If, after the determination in step 112, it is not time to consider adjusting the filtering procedure, then a Sum value is adjusted in step 118 by subtracting the value of the average temperature (AVG) that was calculated in step 120 on the previous pass through the filtering algorithm, adding the current measured temperature (New), and adding the current value of the adjustment variable (Adjust). Using this calculated Sum value a new average is then calculated in step 120 by dividing the Sum value by $2^n$, wherein $2^n$ represents the size of the averaging window. After the new average temperature is calculated in step 120, the calculated value is displayed to the user in step 122 by means of the display device 24, which is coupled to the controller 18, and the algorithm is then repeated.

If, after the determination in step 112, it is time to consider adjusting the filtering procedure, then the open status of the chilling compartment door 13 is tested in step 114 by means of the front door switch 66. If the door is open then the current value of variable n is compared in step 128 to a maximum variable value. If the current value of the variable n is less than the maximum variable value then the value of adjustment variable (Adjust) is calculated in step 130 by multiplying the average temperature (AVG) that was calculated in step 120 on the previous pass through the filtering algorithm by $2^n$. The value of the variable n is then increased in step 132 before calculating a new Sum and average in steps 118 and 120 respectively. After the new average temperature is calculated in step 120, the calculated value is displayed to the user in step 122 by means of the display device 24 and the filtering method is then repeated. By increasing (n) at step 132 and increasing Sum by a non-zero Adjust value which is a factor of the previous average, the size of the averaging window is doubled making the displayed temperature less responsive to changes in temperature within the chilling compartment. In this method it is possible for the size of the averaging window to be increased more than once. It is also possible that the averaging window will not be increased at all if the door 13 is only open for a few seconds.

Referring again to step 128, if the value of the variable n is not less than the maximum variable value, then steps 118, 120 and 122 are performed with no change to n and with Adjust=0.

Referring again to step 114, if the status of the chilling compartment door 13 is determined not to be open, then the value of the variable (n) is compared in step 116 to a minimum variable value. If the value of the variable (n) is greater than the minimum variable value, then the value of the variable (n) is decreased in step 124 and the adjustment variable (Adjust) is calculated in step 126 by multiplying the average temperature that was calculated in step 120 on the previous pass through the filtering algorithm by $2^n$, and taking the negative of that product. A new sum and average are then calculated in steps 118 and 120 respectively. After an average temperature is calculated in step 120, the calculated value is displayed to the user in step 122 by means of the display device 24 and the filtering algorithm is then repeated. By decreasing (n) and then reducing Sum by the negative Adjust value, the size of the averaging window is halved. Referring again to step 116, if the value of the variable n is not greater than the minimum variable value then steps 118, 120 and 122 are performed directly with no change to n and with Adjust=0.

During initialization of the algorithm shown in FIG. 4 there will be no previous sum or previous average temperature until a sufficient number of temperature measurements are taken and stored in the memory of the controller 18. Therefore, in the embodiment shown in FIG. 4, a startup operation may be performed when the unit is turned on, before entering the continuous filtering algorithm, during which a specified number of temperature samples are taken. Using the temperature samples from the startup operation an initial Sum and average temperature (AVG) are calculated for use during the first pass through the filtering algorithm. In other embodiments the startup operation could continue for a specified amount of time rather than a specified number of passes or temperature measurements.

Of course, the illustrated method of reducing the responsiveness of the displayed temperature to changes in temperature within the chilling compartment when the door is opened is merely one of many possible techniques. For example, a list of previously measured temperatures may be maintained in memory and each time the temperature is displayed it may be an average of a certain number (X) of the last measured temperatures as retrieved from the list. When the door is determined to be opened X may be increased in order to increase the size of the averaging window. In another alternative, when the door is determined to be open the frequency with which the air temperature of the chilling compartment is measured may be reduced. In yet another alternative, when the door is determined to be open the frequency with which the average temperature is calculated and displayed may be reduced.

Further, although not illustrated in the flow chart of FIG. 4, it may also be desirable to incorporate a temperature display filtering phase out after the door has been open for a certain time period. For example, if the door is open for more than a certain time, the temperature display filtering routine may automatically begin to make adjustments, such as decreasing the size of the averaging window, to make the displayed temperature less responsive to changes in temperature within the chilling compartment so that the temperature display will alert the user to a door open problem. The certain time period may, by way of example and not by way of limitation, may be 30, 60, 90 or 120 seconds.

Although the invention has been described and illustrated in detail it is to be clearly understood that the same is intended by way of illustration and example only and is not intended to be taken by way of limitation. For example, while the temperature filtering method has been shown and described relative to a chiller having a chilling compartment, it is recognized that a similar filtering method could be used on other types of cooling equipment having temperature displays, such as refrigeration units. As used herein the term "cooling apparatus" is intended to encompass both chillers and refrigeration units, and the term "cooling compartment" is intended to encompass both the chilling compartment of a chiller and the refrigeration compartment of a refrigerator.

Other changes and modifications could be made without departing from the invention. Accordingly, the spirit and scope of the invention are to be limited only by the terms of the appended claims.

What is claimed is:

1. In a chiller including a chilling compartment and a plurality of temperature probes, a method for automatically identifying a temperature probe for use in a chilling operation, comprising the steps of:

(a) inserting at least one of a plurality of temperature probes into a hot food product to be chilled;

(b) obtaining a temperature from each of the plurality of temperature probes; and (c) identifying, for use in a chilling operation, a temperature probe with a corresponding temperature that exceeds a threshold temperature.

2. The method of claim 1, further comprising the step of obtaining an air temperature of the chilling compartment.

3. The method of claim 2, wherein the threshold temperature is determined by adding a specified amount to the air temperature of the chilling compartment.

4. The method of claim 3, wherein the specified amount can be supplied by a user through a user input device.

5. The method of claim 3, wherein the specified amount is a predetermined constant.

6. The method of claim 1, wherein step (b) is initiated by a user through a user input device.

7. The method of claim 1, wherein step (b) is performed repeatedly.

8. The method of claim 1, further comprising the step of:

(d) obtaining a first temperature of each of the plurality of temperature probes at a first point in time, prior to step (b);

wherein in step (c) a distinct threshold temperature is determined for each of the plurality of temperature probes by adding a specified amount to the first temperature of each temperature probe.

9. The method of claim 8, wherein step (d) is performed prior to step (a).

10. The method of claim 8, wherein step (d) is performed after step (a).

11. The method of claim 8, wherein the specified amount can be supplied by a user through a user input device.

12. In a chiller including a chilling compartment having a plurality of temperature probes associated therewith, a method for automatically determining whether a given temperature probe has been selected for use in a chilling operation, the method comprising the steps of:

(a) comparing a temperature of the given temperature probe to a threshold temperature; and (b) determining whether the given temperature probe has been selected for use in the chilling operation based at least in part upon the comparison made in step (a).

13. The method of claim 12 wherein, in step (b), the given temperature probe is determined to have been selected for use in the chilling operation only if the temperature of the given temperature probe exceeds the threshold temperature.

14. The method of claim 12 further comprising the step of:

(c) determining an air temperature within the chilling compartment;

wherein the threshold temperature of step (a) is a specified amount above the air temperature of the chilling compartment.

15. The method of claim 12, wherein the threshold temperature is a specified amount above a prior temperature of the given temperature probe as determined prior to step (b).

16. The method of claim 12 wherein the determination of step (b) is made in order to automatically identify the given probe for use in the chilling operation if a user selected the given probe by placing it in a hot food product.

17. The method of claim 12 comprising the further step of examining the given probe based upon user identification of the given probe via a user input device, wherein the determination of step (b) is made in order to verify that the user identification of the given probe was correct.

18. A chiller apparatus comprising:

a chilling compartment into which hot food products to be chilled are received;

a chilling system for cooling the chilling compartment;

a plurality of temperature probes insertable in food products for monitoring the temperatures of food products during chilling operations; and a controller operatively coupled to the plurality of temperature probes for receiving signals therefrom, the controller operable to determine whether a given temperature probe has been selected for use in a chilling operation based, at least in part, on a signal received from the given temperature probe.

19. The chiller apparatus of claim 18, further comprising an air temperature sensor for obtaining an air temperature of the chilling compartment, wherein the controller is operatively coupled to the temperature sensor for receiving a signal therefrom, the controller further operable to determine whether the given temperature probe has been selected based, at least in part, on the signal received from the air temperature sensor.

20. The chiller apparatus of claim 19, wherein the controller is operable to determine whether the given temperature probe has been selected for use in the chilling operation based, at least in part, on a comparison of a threshold temperature to the temperature of the given temperature probe.

21. The chiller apparatus of claim 20, wherein the controller calculates the threshold temperature as a function of at least: (i) the air temperature of the chilling compartment; and (ii) a specified amount.

22. The chiller apparatus of claim 20, wherein the comparison is performed by the controller for each of the plurality of temperature probes that is not already being used in chilling operations.

23. The chiller apparatus of claim 18, wherein the controller is operable to determine whether to identify the given temperature probe for use in the chilling operation based, at least in part, on a comparison of a threshold temperature to a current temperature of the given temperature probe, wherein the controller calculates the threshold temperature as a function of a least: (i) a prior temperature of the given temperature probe; and (ii) a specified amount.

24. The chiller apparatus of claim 23, wherein the comparison is performed by the controller for each of the plurality of temperature probes that is not already being used in chilling operations.

25. The chiller apparatus of claim 18, wherein the determination of whether the given probe has been selected is made in order to automatically identify the given probe for use in the chilling operation if a user selected the given probe by placing it in a hot food product.

26. The chiller apparatus of claim 18, wherein the determination of whether the given probe has been selected is initiated based upon user identification of the given probe via a user input device, wherein the determination is made in order to verify that the user identification of the given probe was correct.

27. In a cooling apparatus including a cooling compartment and a door that opens to the cooling compartment, a method for displaying a temperature that is representative of an air temperature in the cooling compartment, wherein a status of the door as being open or closed affects a responsiveness of the temperature that is displayed to temperature changes in the cooling compartment.

28. The method of claim 27, comprising the steps of:

(a) measuring the air temperature in the cooling compartment repeatedly; and (b) calculating the temperature that is displayed by averaging a plurality of measured air temperatures in the cooling compartment;

wherein a number of measured air temperatures to be averaged is increased at least once when the door is open.

29. The method of claim 28, wherein the number of measured air temperatures to be averaged is increased only if the door remains open for a given time.

30. The method of claim 27, comprising the steps of:

(a) when the door is closed:

(i) repeatedly measuring an air temperature in the cooling compartment; and (ii) repeatedly calculating an average temperature as a function of previously measured air temperatures in the cooling compartment and displaying the average temperature;

(b) at least once when the door is open:

(i) calculating a new average temperature value as a function of both a new measured temperature and an old average temperature, wherein the old average temperature is weighted by some value greater than one, and displaying the new average temperature.

31. The method of claim 30, wherein step (b)(i) is performed only if the door remains open for a given time.

32. The method of claim 27, comprising the steps of:

(a) measuring the air temperature in the cooling compartment repeatedly; and (b) calculating the temperature that is displayed by a averaging a plurality of measured air temperatures in the cooling compartment;

wherein a frequency with which step (a) is performed is decreased at least once when the door is open.

33. The method of claim 32, wherein the frequency with which step (a) is performed is decreased only if the door remains open for a given time.

34. The method of claim 27, comprising the steps of:

(a) measuring the air temperature in the cooling compartment repeatedly; and (b) calculating the temperature that is displayed by averaging a plurality of measured air temperatures in the cooling compartment;

wherein a frequency with which step (b) is performed is decreased at least once when the door is open.

35. The method of claim 34, wherein the frequency with which step (b) is performed is decreased only if the door remains open for a given time.

36. The method of claim 27, wherein the cooling apparatus comprises one of a refrigerator and a chiller.

37. A cooling apparatus comprising:

a cooling compartment into which hot food products are received;

a door which can be opened to load or unload food products from the cooling compartment;

a door state sensor for monitoring an open/closed state of the door;

a cooling system for cooling the cooling compartment;

an air temperature sensor for obtaining an air temperature of the cooling compartment;

a display device for effecting display of information to a user;

a controller operatively coupled to the air temperature sensor for receiving a signal therefrom, the controller operable to repeatedly establish a display temperature for display by the display device based, at least in part, on the signal received from the air temperature sensor; and wherein, the controller is operatively coupled to receive a signal from the door state sensor, the controller operable at least once during an open state of the door to reduce the responsiveness of the established display temperature to temperature changes in the cooling compartment.

38. The cooling apparatus of claim 37, wherein the controller is operable to calculate the display temperature by averaging a plurality of measured air temperatures in the cooling compartment, the controller further operable to increase a number of measured air temperatures to be averaged when the door is open.

39. The cooling apparatus of claim 37, wherein the controller is operable to calculate the display temperature as function of previously measured air temperatures in the cooling compartment, the controller further operable to calculate the display temperature as a function of a new measured air temperature in the cooling compartment and an old average of a plurality of measured air temperatures in the cooling compartment, wherein the old average is weighted by some value greater than one when the door is open.

40. The cooling apparatus of claim 37, wherein the controller is operable to calculate the display temperature by averaging a plurality of measured air temperatures in the cooling compartment, the controller further operable to decrease the frequency with which the air temperature of the cooling compartment is measured when the door is open.

41. The cooling apparatus of claim 37, wherein the controller is operable to calculate the display temperature by averaging a plurality of measured air temperatures in the cooling compartment, the controller further operable to decrease the frequency with which the display temperature is calculated when the door is open.

42. The cooling apparatus of claim 37, wherein the controller is operable to reduce the responsiveness of the established display temperature to temperature changes in the cooling compartment only if the door is determined to be open for a predetermined time period.

* * * * *